United States Patent [19]

Nagashima

[11] Patent Number: 4,630,372

[45] Date of Patent: Dec. 23, 1986

[54] FRONT HANDLE SUPPORT MEANS OF PORTABLE CHAIN SAW

[75] Inventor: Akira Nagashima, Kawasaki, Japan

[73] Assignee: Kioritz Corporation, Tokyo, Japan

[21] Appl. No.: 646,922

[22] Filed: Sep. 4, 1984

[30] Foreign Application Priority Data

Sep. 7, 1983 [JP] Japan ..... 58-137811[U]

[51] Int. Cl.[4] ..... B27B 17/02

[52] U.S. Cl. ..... 30/381; 188/77 R; 188/166

[58] Field of Search ..... 30/381, 382, 383, 384, 30/385; 188/77 R, 166

[56] References Cited

U.S. PATENT DOCUMENTS 3,776,331 12/1973 Gustafsson .

4,138,812 2/1979 Zimmerer et al. .

4,160,321 7/1979 Kallberg et al. .

4,335,513 6/1982 Owens ..... 30/382

*Primary Examiner*—E. R. Kazenske

*Assistant Examiner*—Willmon Fridie, Jr.

*Attorney, Agent, or Firm*—Browdy and Neimark

[57] ABSTRACT

Front handle support means of a portable chain saw having a built-in internal combustion engine serving as a source of motive force includes a handle support arm connected to one lateral side of a machine frame and extending upwardly to support at its upper end one end of a handle pipe of a front handle. A projection is formed integrally at an upper end portion of the handle support arm and extends forwardly to support a hand guard. A plurality of shock absorbers are mounted on an inner side of the handle support arm to connect the internal combustion engine therethrough to the machine frame.

2 Claims, 3 Drawing Figures

FRONT HANDLE SUPPORT MEANS OF PORTABLE CHAIN SAW

BACKGROUND OF THE INVENTION (1) Field of the Invention

This invention relates to a front handle support means of a potable chain saw having a built-in internal combustion engine serving as a power source.

(2) Description of the Prior Art

A chain saw of the type described generally has a hand guard mounted forwardly of a front handle for protecting the back of the hand of an operator, which serves at the same time as an actuating lever of a safety brake device. However, in chain saws of the prior art, the hand guard is pivotably connected to a member of the drive side which is including an internal combustion engine, separately from front handle support means for supporting the front handle on a machine frame. This arrangement has suffered the disadvantages that the hand guard is often brought into contact with the back of the hand of the operator due to vibration during a sawing operation and that the safety brake device is inadvertently actuated.

SUMMARY OF THE INVENTION

Object of the Invention

This invention has been developed for the purpose of obviating the aforesaid disadvantages of the prior art. Accordingly, the invention has as its object the provision of front handle support means of a portable chain saw, simple in construction, which enables the front handle and the hand guard to be formed as a unitary structure.

Statement of the Invention

According to the invention, there is provided front handle support means of a portable chain saw having a built-in internal combustion engine serving as a power source, comprising a handle support arm connected to one lateral side of a machine frame and extending upwardly, the handle support arm having secured to its upper end one end of a handle pipe of a front handle, a projection formed integrally at an upper end portion of the handle support arm and extending forwardly to support a hand guard, and shock absorber means mounted on an inner side of the handle support arm to connect the internal combustion engine therethrough to the machine frame.

In the front handle support means of a portable chain saw of the aforesaid construction according to the invention, one end of the handle pipe is secured to and supported by the handle support arm which has formed integrally therewith the projection for supporting the hand guard. Thus, the front handle and the hand guard constitute a unitary structure in which the disadvantage of the prior art caused by vibration can be obviated. At the same time, the construction of the chain saw as a whole can be simplified and assembling, disassembling and replacing of parts can be facilitated.

DESCRIPTION OF THE PREFERRED EMBODIMENT

A preferred embodiment of the front handle support means of a chain saw in conformity with the invention will now be described by referring to the accompanying drawings.

Figure 1:
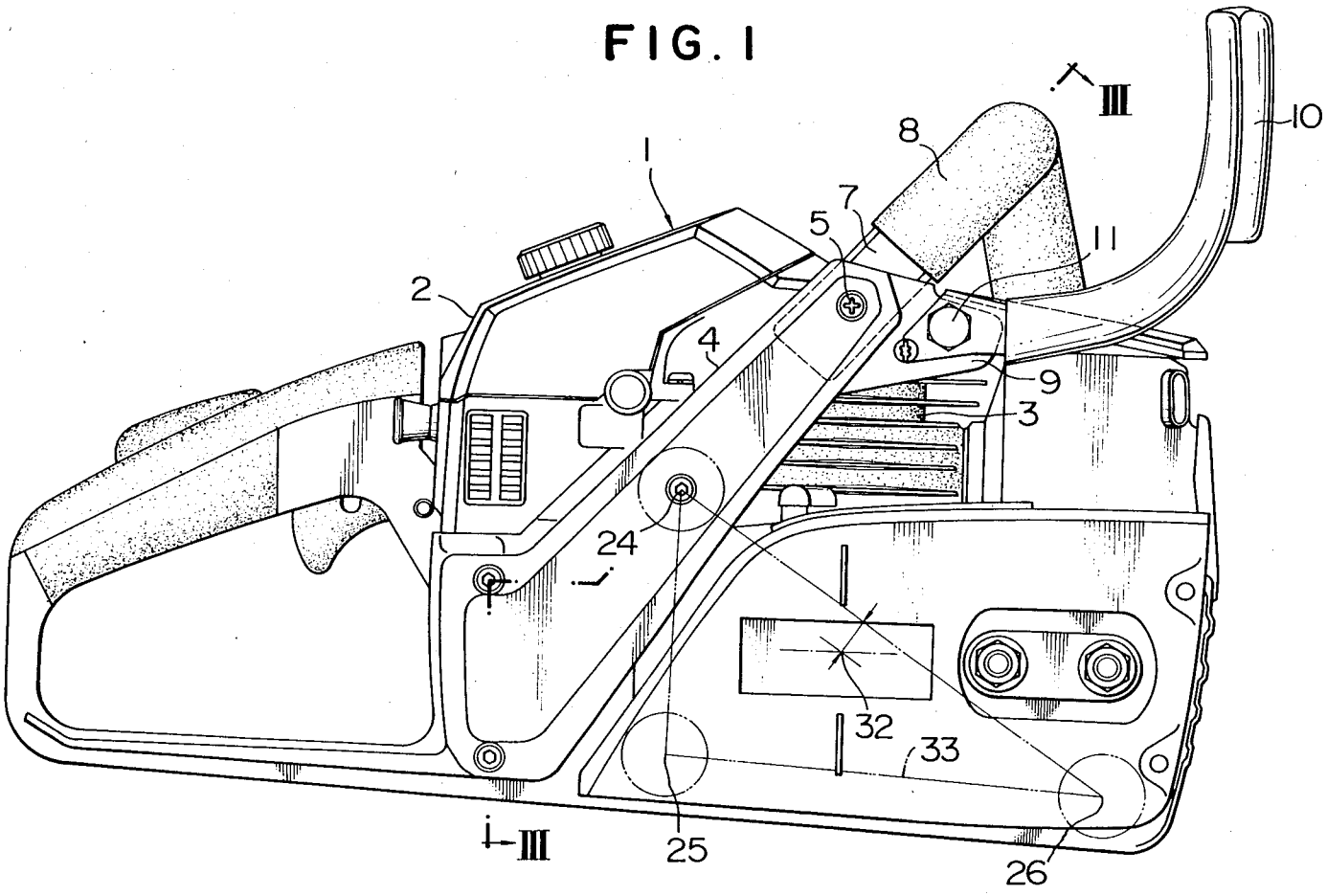
FIG. 1 is a side view of a chain saw incorporating therein the front handle support means comprising one embodiment of the invention.

Referring to FIG. 1, the chain saw generally designated by the reference numeral 1 is provided with a safety brake device and comprises a machine frame 2 surrounding the machine, and an internal combustion engine 3 serving as a power source mounted to the machine frame 2. A handle support arm 4 extending obliquely upwardly is secured to one lateral side of the machine frame 2. One end of a handle pipe 7 is secured to an upper end of the handle support arm 4 by a bolt 5 and a keep member 6 (see FIG. 3). The handle pipe 7 extends above and along an opposite lateral side of the machine frame 2 in a downwardly extending curve, and is secured at an opposite end to a lower portion of the machine frame 2. A sleeve 8 formed as of rubber is mounted to an outer periphery of the handle pipe 7 to constitute a front handle.

Figure 2:
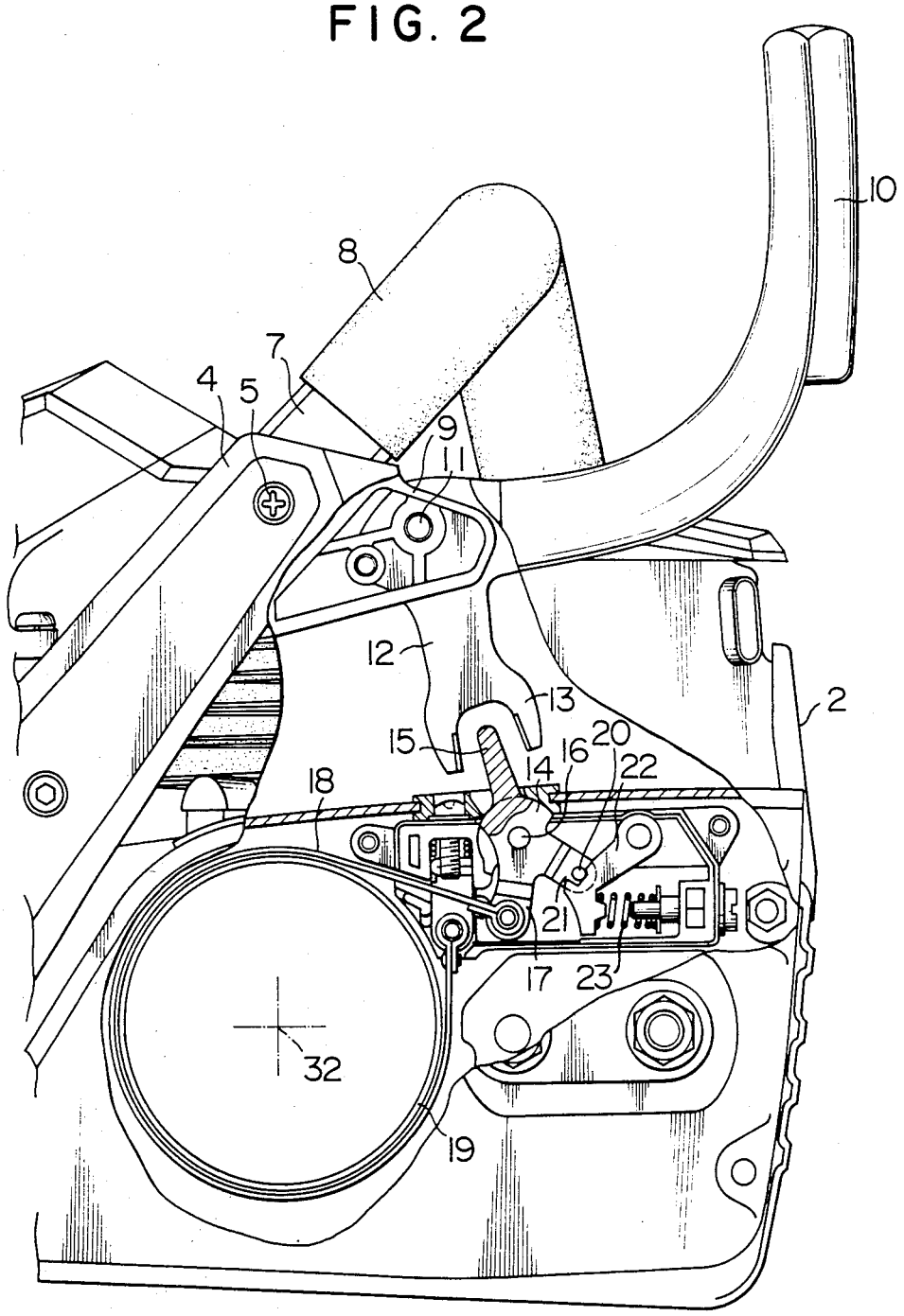
FIG. 2 is a side view, with certain parts being broken away, of the chain saw shown in FIG. 1.

The handle support arm 4 has formed integrally therewith a forwardly extending projection 9 which has a hand guard 10 pivotably connected thereto as indicated at 11. The hand guard 10 has formed integrally therewith an arm 12 extending downwardly through the interior of the machine frame 2 which is bifurcated as indicated at 13 at its lower end portion, as shown in FIG. 2. One end 15 of a brake band actuating lever 14 is positioned in the bifurcation 13 at the lower end of the arm 12. The brake band actuating lever 14 which is pivotably connected as indicated at 16 to members of the drive side including the internal combustion engine 3 has one end of a brake band 18 connected to an opposite end 17 thereof. The brake band 18 which extends around an outer periphery of a clutch drum 19 supported on a rotaty shaft of the internal combustion engine 3 is connected at an opposite end to a member on the drive side. The brake band actuating lever 14 includes a projection 21 having a pin 20 secured thereto which engages a locking lever 22 which, in a normal operation condition shown in FIG. 2, is operative to keep the brake band 18 in an inoperative position in which it is loosened and disposed away from the outer periphery of the clutch drum 19, and, as the brake band actuating lever 14 is pressed by the bifurcated lower end 13 of the arm 12 and moves counterclockwise in FIG. 2, allows the brake band actuating lever 14 to be further moved counterclockwise by the biasing force of a spring 23, to thereby tauten the brake band 18 and bring same into pressing engagement with the outer periphery of the brake drum 19 to apply the brake to the rotary shaft of the internal combustion engine 3.

Figure 3:
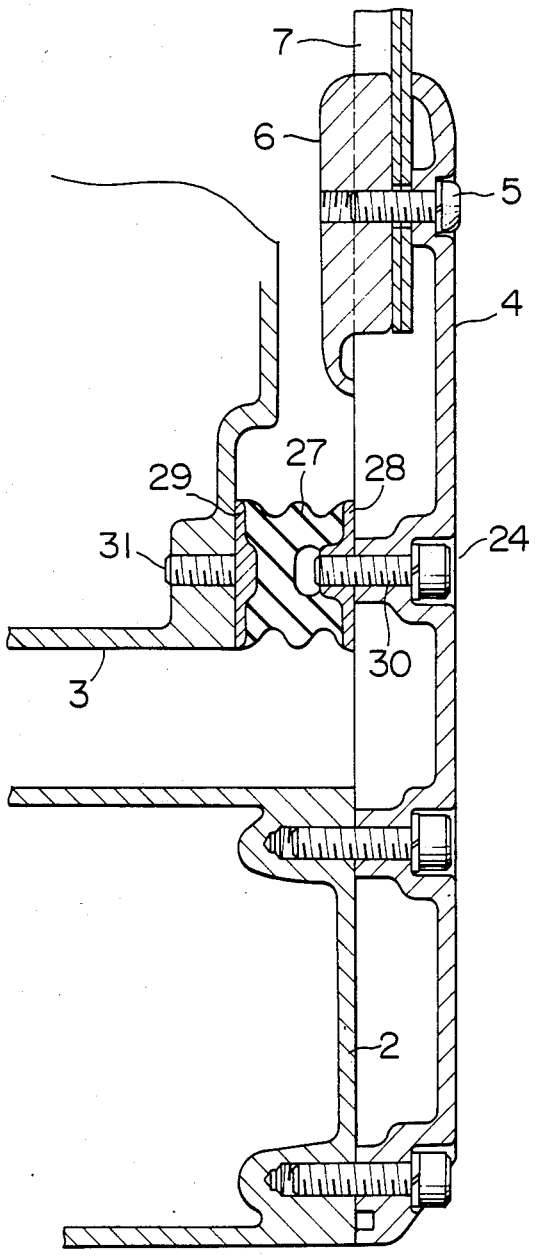
FIG. 3 is a sectional view, with certain parts being broken away, of the chain saw taken along the line III—III in FIG. 1.

The internal combustion engine 3 is mounted to one lateral side of the machine frame 2 at three support points 24, 25 and 26 as shown in FIG. 1. A shock absorber 27 formed as of rubber is mounted between the machine frame 2 and internal combustion engine 3 at each of the support points 24, 25 and 26 as shown in FIG. 3. Each shock absorber 27 has end members 28 and 29 formed as of metal connected to opposite ends thereof. At the support point 24, for example, a screw 30 fitted in an opening formed in the handle support arm 4 is threadably engaged in a threaded opening formed in the end member 28, and a screw 31 secured to the end member 29 is threadably engaged in an threaded opening formed in the internal combustion engine 3, so that the shock absorber 27 is located inwardly of the handle support arm 4. The shock absorber 27 at each of the support points 25 and 26 is constructed as described hereinabove by referring to the shock absorber 27 at the support point 24, to support the internal combustion engine 3 at the one lateral side of the machine frame 2. Thus, vibrations produced while the internal combustion engine 3 is operating are absorbed by the shock absorbers 27, thereby minimizing vibrations transmitted to the machine frame 2. Preferably, the internal combustion engine 3 is arranged such that the center axis of the rotary shaft which is designated by the numeral 32 in FIG. 1 is located in a zone define by phantom lines 33 connecting the support points 24, 25 and 26 together in FIG. 1.

In the construction described hereinabove, as a force of impact of a magnitude higher than a predetermined value is exerted on the hand guard 10, the hand guard 10 is pivotally moved clockwise in FIG. 2. When this is the case, the bifurcated lower end 13 of the arm 12 is brought into engagement with the one end 15 of the brake band actuating lever 14, to move the brake band actuating lever 14 counterclockwise in pivotal movement. At this time, the locking member 22 operates as described hereinabove to tauten the brake band 18 and bring same into frictional and sliding engagement with the outer periphery of the clutch drum 19 to apply the brake to the rotary shaft of the internal combustion engine 3.

In the embodiment of the invention shown and described hereinabove, the internal combustion engine 3 is supported at the three support points 24, 25 and 26 on the machine frame 2 through the shock absorbers 27, and the center axis 32 of the rotary shaft of the internal combustion engine 3 is located in the triangular zone defined having the support points 24, 25 and 26 at its vertexes. By virtue of this feature, it is possible to minimize vibrations transmitted from the internal combustion engine 3 to the machine frame 2 and then to the operator who operates the chain saw 1 while holding same.

What is claimed is:

1. Front handle support means of a portable chain saw having a built-in internal combustion engine serving as a power source, comprising:

a handle support arm connected to one lateral side of a machine frame and extending upwardly, said handle support arm having an upper end secured to one end of a handle pipe of a front handle;

a projection formed integrally at an upper end portion of the handle support arm and extending forwardly to pivotally support a hand guard;

said hand guard having integrally formed therewith an arm for cooperation with an actuating lever of a brake band, whereby forward movement of said hand guard effects rearward movement of said arm to move said brake band actuating lever and effect braking of the chain saw; and shock absorber means mounted on an inner side of said handle support arm to connect the internal combustion engine therethrough to the machine frame.

2. A portable chain saw having a built-in internal combustion engine serving as a power source, comprising:

a machine frame encompassing the internal combustion engine;

a rear handle connected to said machine frame;

a handle support arm connected to one lateral side of said machine frame and extending upwardly to form an upper end;

a handle pipe of a front handle connected at one end thereof to said machine frame and at the other end thereof to said upper end of said handle support arm;

a projection formed integrally at said upper end of said handle support arm and extending forwardly;

hand guard means for controlling a brake for the internal combustion engine, said hand guard means being pivotally connected to said forwardly extending projection, said hand guard having integrally formed therewith an arm for cooperation with an actuating lever of a brake band, whereby forward movement of said hand guard effects rearward movement of said arm to move said brake band actuating lever and effect braking of the chain saw; and shock absorber means mounted on an inner side of said handle support arm to connect the internal combustion engine therethrough to said machine frame.

* * * * *